US007434293B2

(12) United States Patent
Park

(10) Patent No.: US 7,434,293 B2
(45) Date of Patent: Oct. 14, 2008

(54) VACUUM CLEANER

(75) Inventor: Jung-seon Park, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 940 days.

(21) Appl. No.: 10/813,086

(22) Filed: Mar. 31, 2004

(65) Prior Publication Data

US 2005/0050674 A1 Mar. 10, 2005

(30) Foreign Application Priority Data

Sep. 9, 2003 (KR) ..... 10-2003-0063142

(51) Int. Cl.
*A47L 5/00* (2006.01)

(52) U.S. Cl. ..... 15/326; 15/327.2; 15/327.6; 15/353

(58) Field of Classification Search ..... 15/326, 15/327.1–327.7, 350–353; *A47L 5/00*
See application file for complete search history.

(56) References Cited

U.S. PATENT DOCUMENTS 4,970,753 A * 11/1990 Herron, Jr. ..... 15/326
5,289,612 A 3/1994 Glenn, III

FOREIGN PATENT DOCUMENTS

| | | | |
|---|---|---|---|
| DE | 26 15 507 | | 10/1977 |
| DE | 38 15 320 | A1 | 11/1989 |
| JP | 1-314524 | * | 12/1989 |
| JP | 3-272721 | * | 12/1991 |
| JP | 4-218127 | * | 8/1992 |
| JP | 5-176868 | * | 7/1993 |
| JP | 2003-245226 | * | 9/2003 |
| KR | 97020002 | * | 5/1997 |
| KR | 2001-31233 | | 4/2001 |

OTHER PUBLICATIONS

Combined Search and Examination Report issued by the British Patent Office on Jan. 12, 2005 in connection with corresponding British Applicaiton No. 0418646.6.

* cited by examiner

*Primary Examiner*—David A Redding
(74) *Attorney, Agent, or Firm*—Blank Rome LLP

(57) ABSTRACT

A vacuum cleaner is disclosed. The vacuum cleaner includes a motor casing to receive a driving motor with an air outlet through which air from a dust collecting chamber flows. The vacuum cleaner includes a cleaner body with a driving chamber that receives the motor casing therein. An air discharge unit is disposed at the cleaner body through which air which flows from the motor casing of the driving motor is discharged to an outside of the driving chamber. Noise reduction is achieved by guiding and reversing a discharging direction of air discharged from the motor casing at least two times.

9 Claims, 5 Drawing Sheets

VACUUM CLEANER

REFERENCE TO RELATED APPLICATIONS

This application claims the benefit of Korean Patent Application No. 2003-63142, filed Sep. 9, 2003 in the Korean Intellectual Property Office, the disclosure of which is incorporated herein by reference in its entirety.

CROSS-REFERENCE TO RELATED APPLICATIONS

This application is related to copending applications entitled "Cyclone-Type Dust collecting Apparatus for Vacuum Cleaner" (Korean Application No. 10-2002-0077811, filed Dec. 9, 2002), and "Dust Collecting Apparatus for Cyclone Type Vacuum Cleaner" (Korean Application No. 10-2003-0012029, filed Feb. 26, 2003) which disclosures are commonly owned by the same assignee as the present application, and are entirely incorporated herein by reference.

FIELD OF THE INVENTION

The present invention generally relates to a vacuum cleaner.

BACKGROUND OF THE INVENTION

FIG. 1 illustrates a vacuum cleaner disclosed in Korean Patent Application No. 2001-31233 by the present applicant. As shown in FIG. 1, the vacuum cleaner includes a cleaner body 10, a cyclone unit 20, and a dust receptacle 30. A vacuum generator, that is, a driving motor (not shown) is mounted in the cleaner body 10. A suction brush 12 is movably connected to the lower part of the cleaner body 10. A cyclone receiving 13 is disposed at the center part of the front side of the cleaner body 10.

At the upper part of the cyclone unit 20, an inlet path 21 is disposed to fluidly-communicate with the suction brush 12. Contaminants on a surface to be cleaned are drawn-in through the suction brush 12 and the inlet path 21 into the cyclone unit 20. The air drawn-in through the inlet path 21 forms a whirling current along the inner wall of the cyclone unit 20.

An outlet path 22 is disposed at the center part of the upper side of the cyclone unit 20 to fluidly-communicate with the driving motor. The contaminants are separated from air in the cyclone unit 20, and the clean air is discharged outside of the cleaner body 10 through the outlet path 22 and the vacuum generator. The dust receptacle 30 is detachably connected to the lower part of the cyclone unit 20 by left-and-right movement of an operating lever 41. The driving motor is installed in a driving chamber 17 which is disposed at the lower part of the cyclone receiving unit 13. The driving chamber 17 fluidly-communicates with the cyclone unit 20 through an air outlet path 15. An air inlet path 14 connects the suction brush 12 with the cyclone unit 20 to fluidly-communicate therethrough.

According to the vacuum cleaner as configured above, due to a suction force generated by the driving unit, air is drawn into the cyclone unit 20 through the suction brush 12 and the air inlet path 14. Air cleaned in the cyclone unit 20 is disposed into the driving chamber 17 through the air outlet path 15 and discharged outside via the driving motor.

Air passed through the driving motor is directly discharged outside. If the path through which air is discharged is short, excessive noise is generated. Specifically, if an air outlet port is disposed on a front wall or sidewall of the driving chamber 12, the noise worsens. Accordingly, it is required to configure a vacuum cleaner capable of reducing the noise of the discharging air.

Thus, a heretofore unaddressed need exists in the industry to address the aforementioned deficiencies and inadequacies.

SUMMARY OF THE INVENTION

An object of the present invention is to provide an improved vacuum cleaner that reduces noise by extending a discharging path of air that flows through a driving motor.

To achieve the above aspect, the vacuum cleaner according to a preferred embodiment of the present invention, includes a motor casing to receive a driving motor with an air outlet through which air from a dust collecting chamber flows, a cleaner body with a driving chamber which receives the motor casing therein, and an air discharge unit disposed at the cleaner body through which air disposed from the motor casing of the driving motor is discharged to an outside of the driving chamber. The air discharge unit reduces noise by guiding and reversing a discharging direction of air discharged from the motor casing at least two times.

The air discharge unit includes a first and second guide walls forming a front side of the driving chamber, with opposite end portions thereof being stepped to form an air discharge port therebetween, and, a filter assembly connected to cover an outer side of the first and second guide walls and to filter air discharged through the air discharge port. The filter assembly includes a grill cover detachably connected to the outer side of the first and second guide walls with a discharging grill portion to discharge air, and a sound absorption member formed of a porous material and disposed between the grill cover and the guide walls. The discharging grill portion may be formed in misalignment with the air discharge port to indirectly face each other.

A plurality of oblique ribs may be formed protruding from the outer side of the first and second guide walls at an interval. The oblique ribs are integrally formed to connect the stepped end portions of the first and second guide walls, respectively. The oblique ribs are formed the same height with respect to the outer side of the guide walls, respectively. The first guide wall is formed in a plate shape adjacent to the motor casing, and the second guide wall is formed in a round shape farther from the motor casing than the first guide wall so that each of the end portions of the guide walls forms the air discharge port. Air from the motor casing is reversed by the guidance of an inner side of the second guide wall, guided to the outer side of the second guide wall, and disposed to the sound absorption member. The discharging grill portion of the grill cover may be formed corresponding to the second guide wall.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWING FIGURES

These and other aspects and advantages of the invention will become apparent and more readily appreciated from the following description of the embodiments, taken in conjunction with the accompanying drawings. The components in the drawings are not necessary to scale, emphasis instead being placed upon clearly illustrating the principles of the present invention. Moreover, in the drawings, like references numerals designate corresponding parts throughout the several views.

DETAILED DESCRIPTION OF THE PREFERRED EMBODIMENT

A vacuum cleaner according to a preferred embodiment of the present invention will be described in greater detail with reference to the annexed drawing figures.

Figure 1:
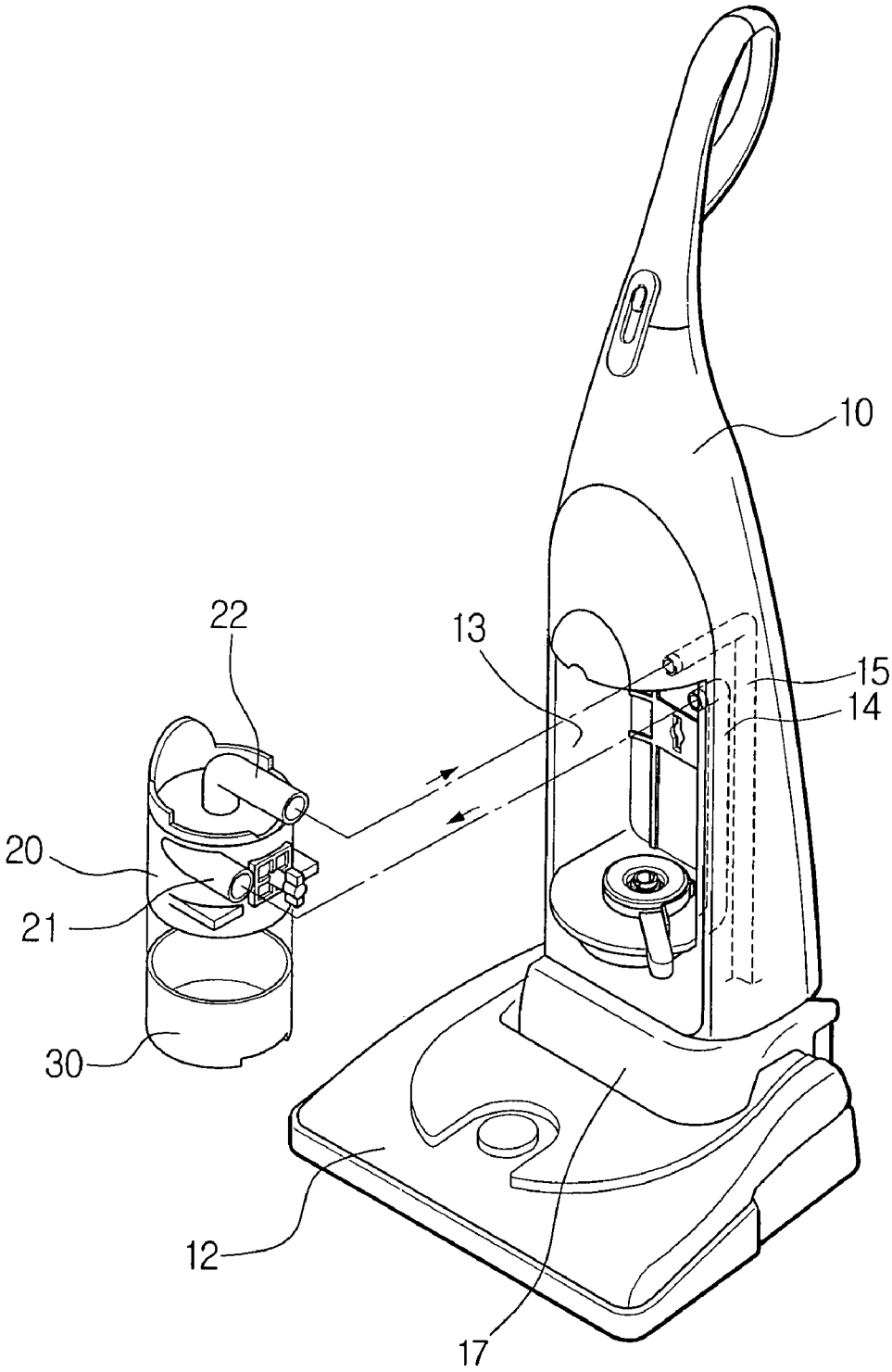
FIG. 1 (PRIOR ART)
FIG. 1 is a drawing of an exploded perspective view illustrating a conventional vacuum cleaner.
Figure 2:
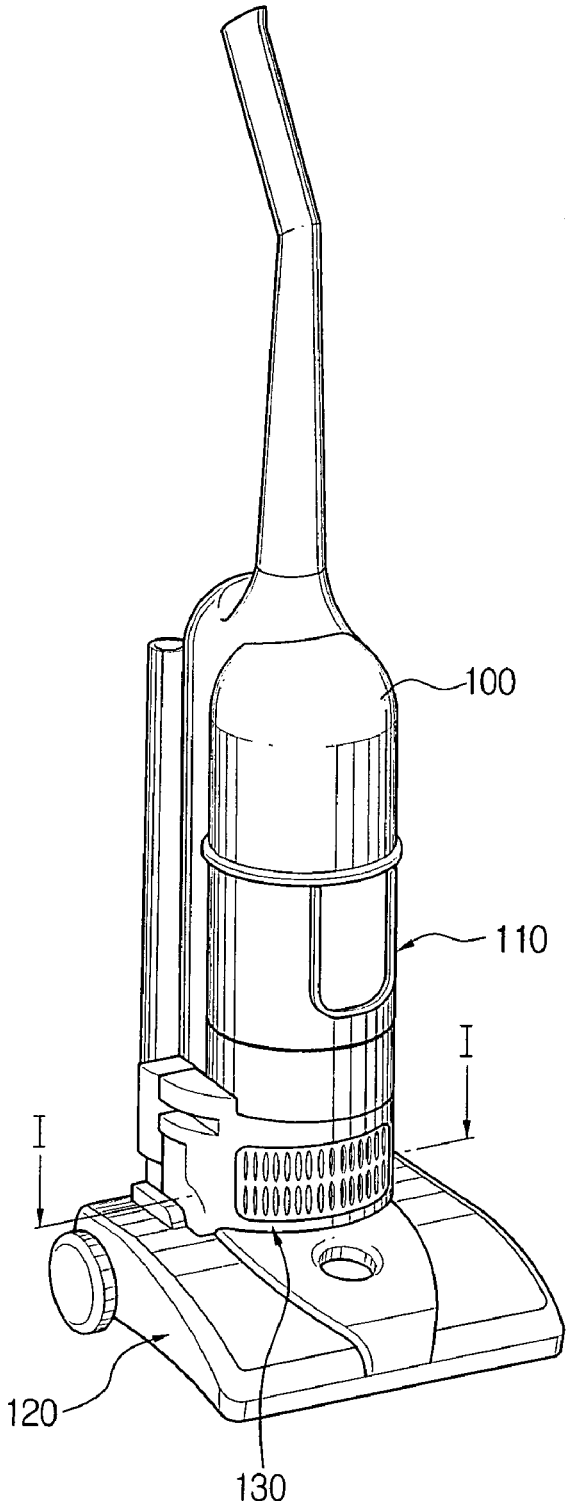
FIG. 2 is a drawing of a perspective view illustrating a vacuum cleaner according to an embodiment of the present invention.

Referring to FIG. 2, the vacuum cleaner includes a cleaner body 100 with a dust collecting chamber 110, a suction brush 120 movably disposed at the lower part of the cleaner body 100, and a driving chamber 130 disposed at the lower part of the dust collecting chamber 110. As described in FIG. 1, the dust collecting chamber may receive a conventional cyclone unit. Also, a dust bag may be installed in the dust collecting chamber 110. The configurations of the dust collecting chamber 110 and the suction brush 120 do not limit the present invention, so a detailed description thereon, will be omitted for conciseness.

Figure 3:
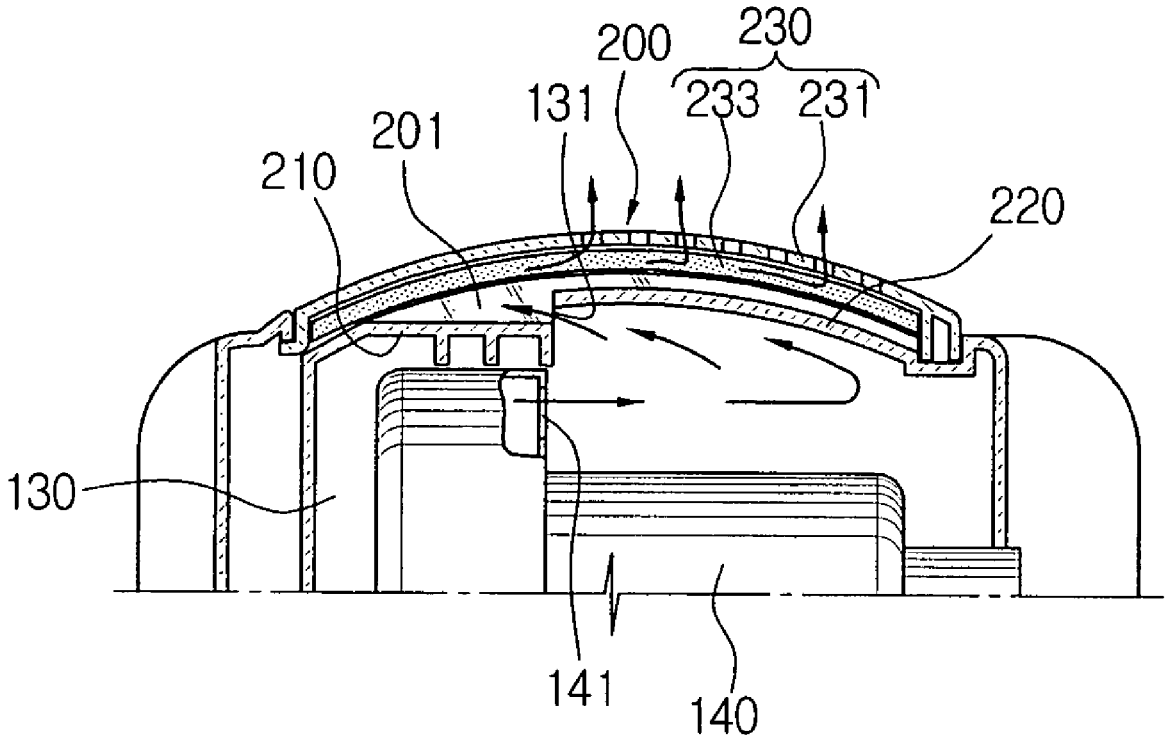
FIG. 3 is a drawing of a sectional view illustrating the vacuum cleaner taken along the line I-I of FIG. 2.

Referring to FIG. 3, a motor casing 140 is disposed in the driving chamber 130 to receive a driving motor therein. As described in FIG. 1, the motor casing 140 fluidly-communicates with the dust collecting chamber 110 through an air outlet path. Accordingly, by a suction force generated by the driving motor in the motor casing 140, foreign air is drawn into the dust collecting chamber 110 through the suction brush 120, and the drawn-in air is filtered and disposed through the motor casing 140. At the rear part of the motor casing 140, an air outlet 141 is disposed. Hence, the driving chamber (not shown) with the motor casing 140 is configured to be internally sealed up. Air disposed from the air outlet 141 of the motor casing 140 is discharged outside of the driving chamber 130 with abundant noise generated. Thus, an air discharge unit 200 is provided to reduce the noise. The air discharge unit 200 guides and reverses air, which is discharged from the motor casing 140, to a discharging direction at least two times thus reducing the noise generated.

The air discharge unit 200 includes a first and a second guide walls 210, 220 forming the front wall of the driving chamber 130, and a filter assembly 230 connected to the outside of the guide walls 210, 220. The first guide wall 210 is formed in a plate shape adjacent to the motor casing 140. The second guide wall 220 is formed in a round shape farther away from the motor casing 140. than the first guide wall 210. An end portion of the first guide wall 210 is connected to the motor casing 140, and an area between the first guide wall 210 and the motor casing 140 is sealed up. Each end portion of the first and second guide walls 210, 220 is stepped at a different height, and an air discharge port 131 is formed between the end portions.

Accordingly, air flown from the air outlet 141 of the motor casing 140 is reversed at about 180°, guided in contact with the inner side of the second guide wall 220, and discharged through the air discharge port 131. Discharged air from the air discharge port 131 is guided, in contact with the outer side of the first guide wall 210. Oblique ribs 210 are provided at the outer sides of the first and second guide walls 210, 220 protruding at a predetermined interval. Each of the oblique ribs 210 is formed in a round shape to externally include the same height. Integrally formed to connect each of the end portions of the guide walls 210, 220, the oblique ribs 210 can provide a function to guide the airflow and another function to reinforce the guide walls 210, 220.

Figure 4:
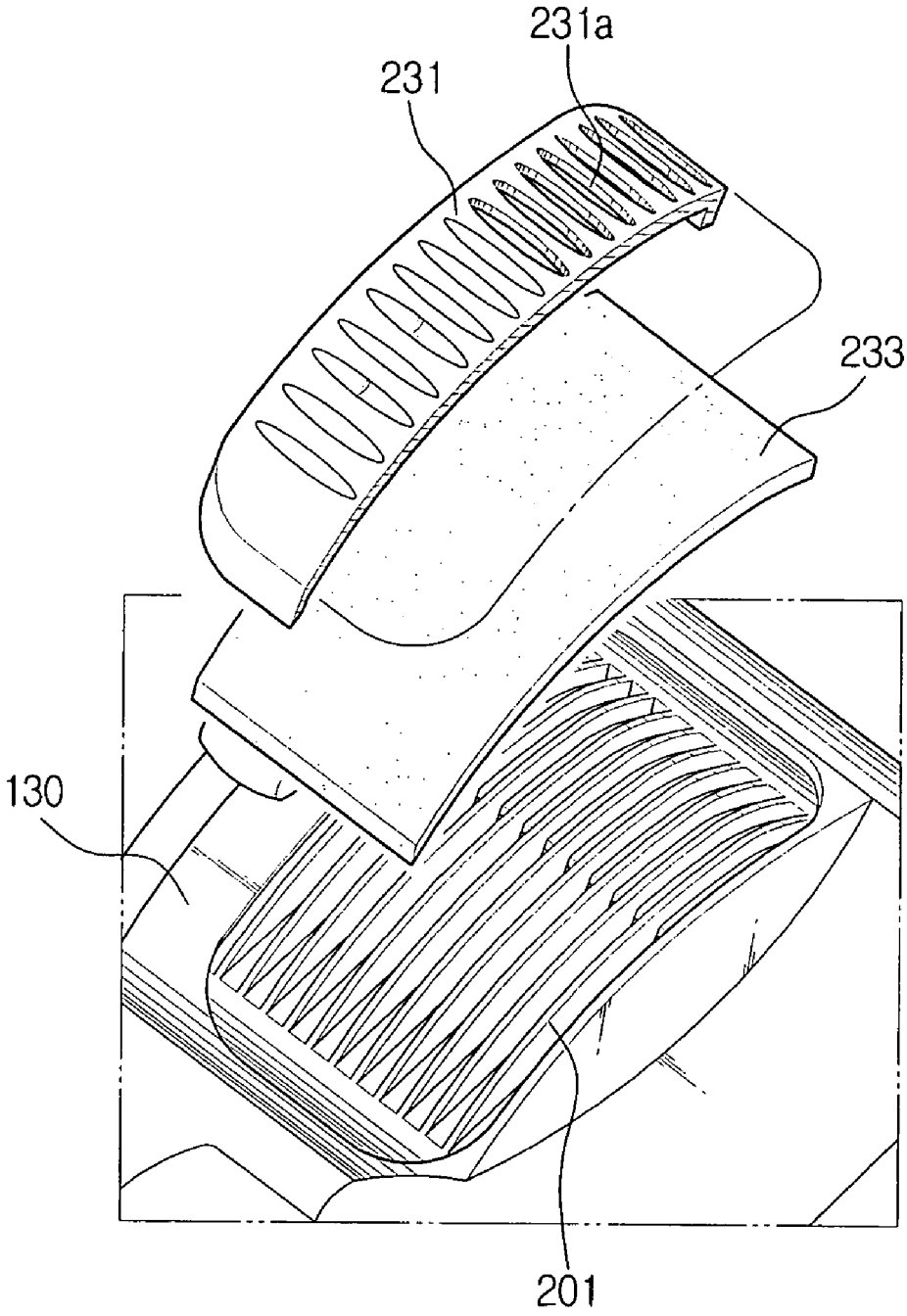
FIG. 4 is a drawing of an exploded perspective view illustrating the main parts of FIG. 2.
Figure 5:
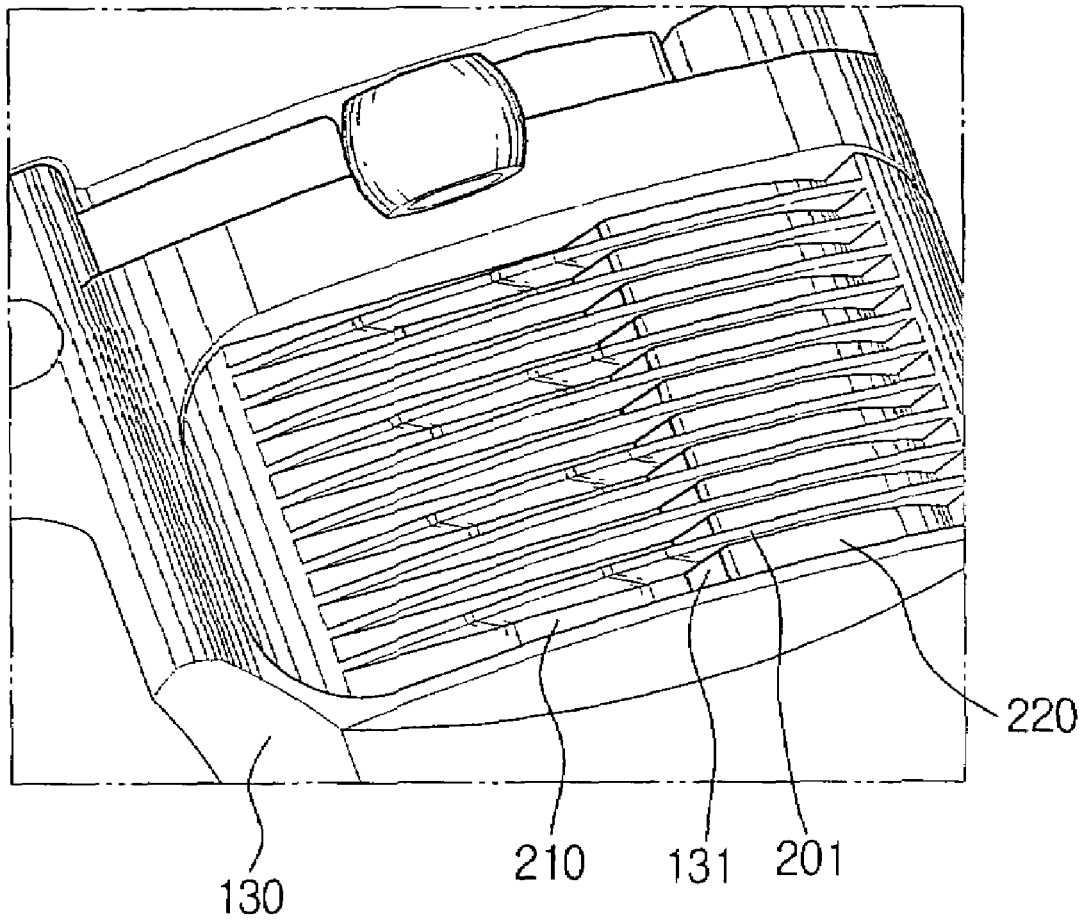
FIG. 5 is a drawing of an enlarged view illustrating the external of the driving chamber of FIG. 2.

The filer assembly 230 includes a grill cover 231 connected to the outer side of the first and second guide walls 210, 220, and a sound absorption member 233 disposed between the grill cover and the guide walls 210, 220. The grill cover 231 is detachably installed to cover the outer side of the guide walls 210, 220. Referring to FIGS. 4 and 5, the grill cover 231 includes a discharging grill portion 231*a* with openings through which the air is discharged outside. The discharging grill portion 231*a* is formed corresponding to the second guide wall 220 to not directly face the air discharge port 131. The sound absorption member 233 is formed with a porous sound absorbent and attached to the inner side of the grill cover 231 to position at the outer side of the guide walls 210, 220. The sound absorption member 233 absorbs the noise generated by the discharged air and also filters fine contaminants from the air.

According to one embodiment of the present invention, the flow direction of air which is discharged from the air outlet 141 of the motor casing 140 is reversed in the driving chamber 130. Reversed air flows between the first guide wall 210 and the sound absorption member 233 via the air discharge port 131 of the driving chamber 130. Between the first guide wall 210 and the sound absorption member 233, the flow direction of air is reversed again and flows into the sound absorption member 233. Air flows through the sound absorption member 233 in a non-oblique direction with respect to the outer side of the sound absorption member 233, and then flows to the discharging grill portion 231*a* of the grill cover 231. Since the discharging grill portion 131*a* does not face the first guide wall 210, air flows through the discharging grill portion 131*a* in contact with the sound absorption member 233, and is discharged outside. As a result, the discharging path of air and the time in contact with the sound absorption member 233, are extended to effectively reduce the noise. Also, since the small spaces are efficiently used by reversing the discharging path of air by 180° twice, the discharging noise can be reduced.

With the vacuum cleaner according to the embodiment of the present invention described above, the discharging path of air flows from the driving chamber is formed in a zigzag pattern. Thus, the discharging path of air is extended to reduce the discharging noise. Further, the discharging grill portion of the grill cover is formed in misalignment with the air discharge port to extend the time for discharged air to contact with the sound absorption member to thereby maximize the sound absorptivity.

Although a few embodiments of the present invention have been shown and described, the present invention is not limited to the disclosed embodiments. Rather, it would be appreciated by those skilled in the art that changes and modifications may be made in this embodiment without departing from the principles and spirit of the invention, the scope of which is defined by the claims and their equivalents.

What is claimed is:

1. A vacuum cleaner comprising:

a motor casing to receive a driving motor with an air outlet through which air from a dust collecting chamber flows;

a cleaner body with a driving chamber which receives the motor casing therein; and an air discharge unit disposed at the cleaner body through which air flows from the motor casing of the driving motor and is discharged to an outside of the driving chamber, to reduce noise by guiding and reversing a discharging direction of the air discharged from the motor casing at least two times, the air discharge unit having a first and second guide walls forming a front side of the driving chamber, with opposite end portions thereof being stepped to form an air discharge port therebetween, a filter assembly connected to cover an outer side of the first and second guide walls and to filter air discharged through the air discharge port, and a plurality of oblique ribs protruding from the outer side of the first and second guide walls at an interval.

2. The vacuum cleaner of claim 1, wherein the filter assembly comprises:

a grill cover detachably connected to the outer side of the first and second guide walls with a discharging grill portion to discharge the air; and a sound absorption member formed of a porous material and disposed between the grill cover and the guide walls.

3. The vacuum cleaner of claim 2, wherein the discharging grill portion is misaligned with the air discharge port so as to not directly face the air discharge port.

4. The vacuum cleaner of claim 1, wherein the oblique ribs are integrally formed to connect the stepped end portions of the first and second guide walls respectively.

5. The vacuum cleaner of claim 1, wherein the oblique ribs are formed in the same height with respect to the outer side of the guide walls respectively.

6. The vacuum cleaner of claim 4, wherein the oblique ribs are formed in the same height with respect to the outer side of the guide walls respectively.

7. The vacuum cleaner of claim 2, wherein the first guide wall is formed in a plate shape adjacent to the motor casing, and the second guide wall is formed in a round shape farther from the motor casing than the first guide wall so that each of the end portions of the guide walls forms the air discharge port.

8. The vacuum cleaner of claim 7, wherein the air from the motor casing is reversed by the guidance of an inner side of the second guide wall, guided to the outer side of the second guide wall, and flowed to the sound absorption member.

9. The vacuum cleaner of claim 7, wherein the discharging grill portion of the grill cover is formed corresponding to the second guide wall.

* * * * *